US008727493B2

(12) United States Patent
Cofler

(10) Patent No.: US 8,727,493 B2
(45) Date of Patent: May 20, 2014

(54) PRINTHEAD MODULES

(75) Inventor: Marian Cofler, Kfar yona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 214 days.

(21) Appl. No.: 13/269,926

(22) Filed: Oct. 10, 2011

(65) Prior Publication Data

US 2013/0088536 A1 Apr. 11, 2013

(51) Int. Cl.
*B41J 23/00* (2006.01)

(52) U.S. Cl.
USPC ..... 347/37; 347/9; 347/12; 347/40; 347/14

(58) Field of Classification Search
USPC ..... 347/9, 12, 13, 14, 19, 21, 40, 42, 43, 347/37, 49, 101–102
See application file for complete search history.

(56) References Cited

U.S. PATENT DOCUMENTS 5,870,117 A * 2/1999 Moore ..... 347/37
7,850,271 B2 12/2010 Gothait et al.
2008/0231679 A1 9/2008 Nakhmanovich et al.

* cited by examiner

*Primary Examiner* — Juanita D Jackson

(57) ABSTRACT

In an example this disclosure relates to printhead modules arranged to move with respect to each other.

13 Claims, 7 Drawing Sheets

PRINTHEAD MODULES

BACKGROUND

Printhead assemblies have printheads or modules of printheads. Printhead assemblies are part of a printer. Some printhead assemblies are arranged in page wide arrays, other printhead assemblies scan over a substrate. Printhead modules have nozzles for printing. Fluid reservoirs are connected to the printhead modules for supplying fluid of a predetermined color during printing.

BRIEF DESCRIPTION OF THE DRAWINGS

For the purpose of illustration, certain examples of the present invention will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that also examples or elements that are not literally disclosed may be derived from the description and drawings by a person skilled in the art.

Figure 1:
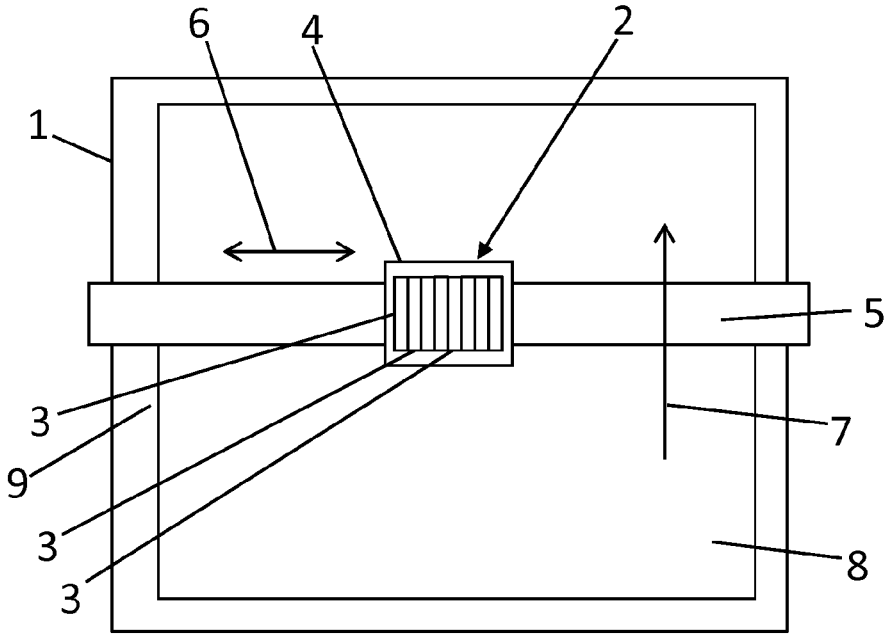
FIG. 1 shows a diagram of an example of a print system in top view.

FIG. 1 shows an example of a print system 1. The print system 1 includes a scanning printhead assembly 2. The printhead assembly 2 includes printhead modules 3. The printhead modules may be arranged to eject print fluid, for example through PIJ (Piezo Inkjet) or TIJ (Thermal Inkjet) technology. The printhead modules 3 are arranged to eject colored print fluids, for example C (Cyan), M (Magenta), Y (Yellow) and K (Black). In the shown diagrammatic example, the printhead modules 3 are arranged in one line. The printhead assembly 2 may print at a predetermined resolution, for example depending on the number and location of the print strokes over a particular region in of the print media 8. In another example, the printhead assembly 2 may include multiple arrays of printhead modules 3. In another example, the printhead modules 3 may be arranged in a staggered arrangement.

The printhead assembly 2 comprises a chassis 4 for mounting and positioning the printhead modules 3. The chassis 4 may include a carriage for scanning the printhead assembly 2 along a scanning axis 5 in a scanning direction 6, perpendicular to a media advance direction 7 of a print media 8.

For example, the print system 1 may be a flat bed printer wherein a printhead assembly 2 advances over the media 8, or the print system 1 may be a media advancing print system that in use advances media under the printhead assembly 2. In this disclosure, the media advance direction 7 may be understood as one of a direction wherein the media 8 advances with respect to the printhead assembly 2 and a direction wherein the printhead assembly 2 advances with respect to the media 8, for printing swaths of fluid on the media 8. The media 8 may advance stepwise, for example when printing in swaths, or continuously, for example for page wide arrays. A print platen 9 may be provided for supporting the media 8. The print platen 9 may be as wide as a maximum media width, and/or approximately as wide as the scanning axis.

Figure 2:
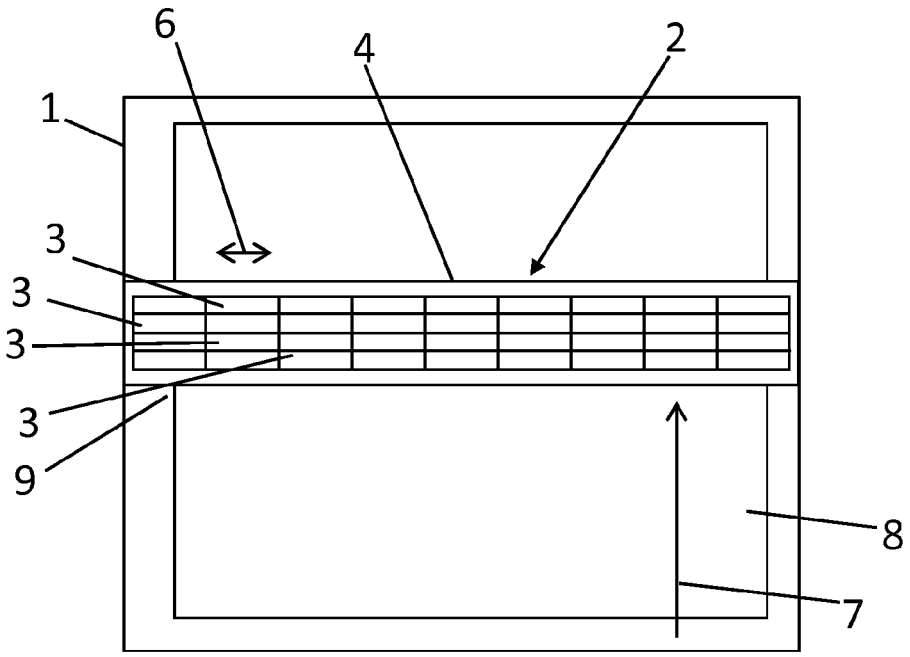
FIG. 2 shows a diagram of another example of a print system in top view.

FIG. 2 shows another example of a print system 1 with a page wide array (PWA) printhead assembly 2. The printhead assembly 2 may include multiple rows and/or columns of printhead modules 3. For example, the printhead modules 3 may be arranged in a matrix and/or a staggered structure with respect to each other. The printhead modules 3 extend over the width of the print platen 9 for printing over the width of the media 8. The printhead modules 3 are mounted on a chassis 4, extending over the width of the print platen 9. In certain examples, the printhead assembly 2 may be arranged to scan over a relatively small distance, in a scanning direction 6 perpendicular to the media advance direction 7, for example for calibration purposes. In a further example, the printhead assembly 2 is arranged to move parallel to the media advance direction 7.

The printhead assemblies 2 of FIGS. 1 and 2 may comprise modular printhead assemblies 2 wherein printhead modules 3 may be exchanged, added or taken out of the chassis 4. Within the printhead assembly 2 the printhead modules 3 are arranged to move over one or multiple predetermined distances, wherein each movement over said predetermined distance may alter an output resolution of the printhead assembly 2.

Figure 3:
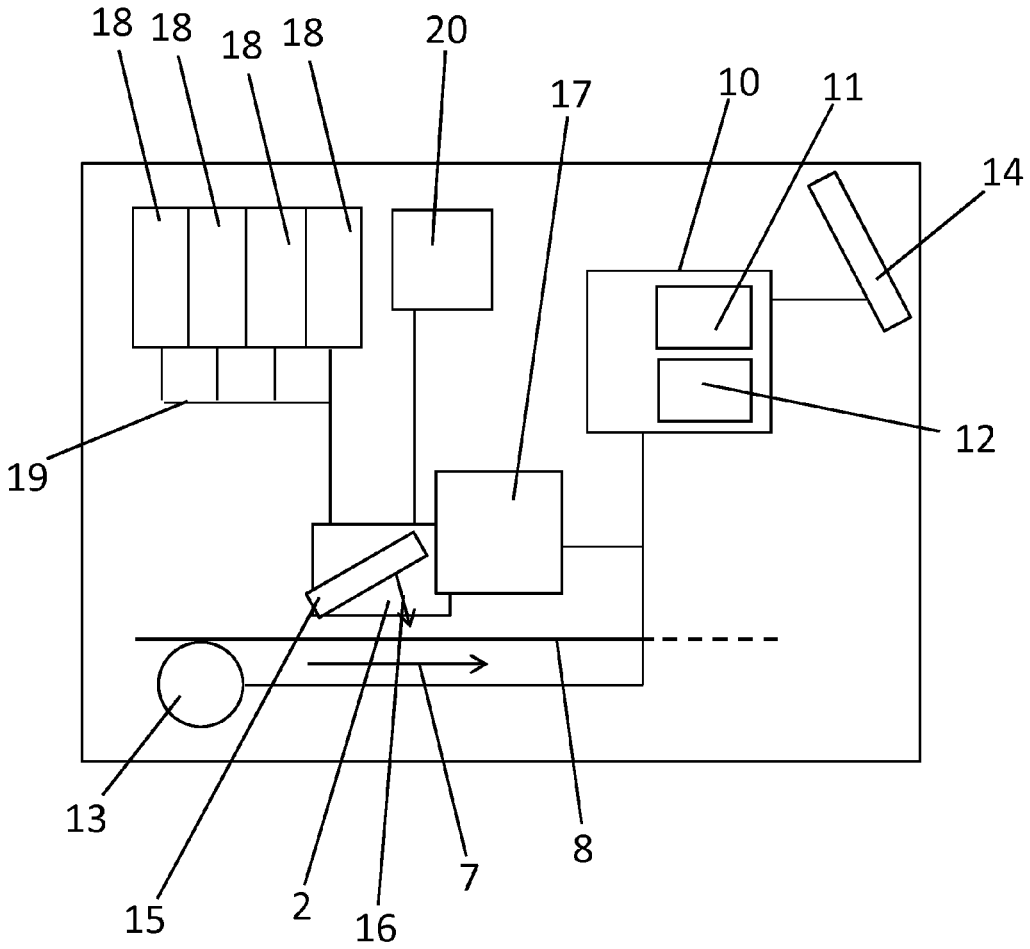
FIG. 3 shows a diagram of another example of a print system in side view.

FIG. 3 shows another example of a diagram of a print system 1. The print system 1 includes circuitry 10 for exchanging data and instructing various print components. For example, the circuitry 10 includes a control circuit 11 and a memory arrangement 12. The control circuit 11 includes an integrated circuit, for example a digital and an analogue integrated circuit. The control circuit 11 may be arranged to instruct the printhead modules 3 in the printhead assembly 2 for printing. The control circuit 11 may be configured to instruct a media advance system 13 for advancing the media 8 with respect to the printhead modules 3 and/or other components. The circuitry 10 is connected to an operator panel 14, for example for receiving instructions from or for communicating to an operator. The operator panel 14 may include a visual display. In an example, the operator panel 14 is configured to receive instructions associated with a print mode, for example so that an operator or user may set a print mode of the print system 1, for example relating to an output resolution, media advance speed, color arrangement, fluid colorant concentration, swath height, and/or predetermined printhead module positions in the printhead assembly 2.

In an example, the memory arrangement 12 may store different print modes. For example, different print modes may pertain to different output resolutions, media advance speeds, color arrangements, fluid colorant concentrations, swath heights, and/or printhead arrangements of the printhead assembly 2. In this disclosure at least one printhead module 3 or printhead module array is arranged to be moved with respect to the other printhead modules 3 or other printhead module array, for example so that an output resolution can be set.

In an example, the printhead assembly 2 includes a shaping fluid dispenser 15. The shaping fluid dispenser 15 is arranged near the printhead modules 3 for dispensing shaping fluid onto printed dots on the media 8 shortly after printing the respective dots, for example for flattening the dots. An example shaping fluid dispensing direction 16 is shown. For example, the shaping fluid includes a gas. For example shaping fluid is blown onto the printed dots for flattening the dots. For example, dispensing the shaping fluid provides for a flattening and increasing of the printed dots. For example, applying the shaping fluid may decrease a thickness of a printed layer. For example, the shaping fluid dispenser 15 is arranged near at least one, or near both sides of a printhead assembly 2. The control circuit 11 may be arranged to instruct the shaping fluid dispenser 15.

In certain examples, the shaping fluid may be applied to flatten a concentrated fluid, for example an ink with a relatively high concentration of colorant. In this disclosure a colorant may be understood as being the element of the fluid that colorizes the fluid, for example a dye or pigment, whereas other fluid components may for example be the binding agent, the carrier, vehicle, additive, diluents, resin, surfactant, etc. For example, at least some of the connected fluid reservoirs 18 may contain concentrated print fluid that has more than 4% colorant concentration in weight. The shaping fluid dispenser 15 is arranged to dispense the shaping fluid onto the concentrated fluid printed on the media for flattening the dots. Using highly concentrated fluid and shaping may provide for a more efficient print fluid consumption. In an example, using highly concentrated fluid and flattening the fluid may be used for billboard printing.

In an example, the print system 1 includes an irradiator 17. The irradiator 17 is arranged to irradiate the printed dots. For example, the irradiator 17 is arranged near the printhead modules 3. For example, the irradiator 17 is arranged near one or both sides of the printhead assembly 2, for irradiating the printed fluid. For example, the irradiator 17 may be arranged to emit at least one of UV light, heat, Infrared light, etc. For example, the irradiator 17 may facilitate at least one of drying, curing and hardening of the fluid that has been printed on the media 8. For example, the shaping fluid dispenser 15 and the irradiator 17 are connected to the scanning printhead assembly 2 for shaping and irradiating the printed fluid during printing.

In a further example, the print system 1 includes fluid reservoirs 18 that supply the fluid to the printhead modules 3. The fluid reservoirs 18 may be connected to the printhead modules 3 through channels 19. For example, the fluid reservoirs 18 include fluid for printing respective C, M, Y and K colors. The fluid reservoirs 18 may be replaceable fluid reservoirs 18.

For example, a fluid reservoir 18 that is connected to a particular printhead module 3 may be exchanged with another fluid reservoir 18 of another color. For example, different fluid reservoirs 18 that may have different colors or different colorant concentrations may be consequently connected to the same printhead module 3. The printhead module 3 and the fluid channels 19 may be flushed before being connected to another fluid reservoir 18 of another color. For example, in a first mode the printhead assembly 2 may be arranged to print the colors C, Lc (Light Cyan), M, Lm (Light Magenta), Y, Ly (Light Yellow), K and Grey. For example, in a second print mode the color arrangement of the printhead assembly 2 may be C, C, M, M, Y, Y, K and Grey. For example, the print system 1 may be configured to print higher quality images in the first mode. For example, the print system 1 may be configured to print at a higher media advance speed in the second mode. For example, the print system 1 may be configured to print at a lower resolution in the second mode than in the first mode. For example, the first mode may be applied for print outs for viewing at a relatively close distance, and the second mode may be applied for print outs that are for viewing at a relatively larger distance and for relatively large printouts such as billboards. The skilled person will understand that the mentioned colors are examples and in other examples other colors or colorant concentrations may be used and exchanged. A flushing of the respective printhead modules 3 may be executed before each color change or colorant concentration change.

In a further example, the print system 1 includes a flush system 20. The flush system 19 may be arranged to flush the printhead modules 3. The flush system 20 may be arranged to flush channels, including the fluid delivery channels 19 between the fluid reservoirs 18 and the printhead modules 3, and in the printhead module 3. In an example, respective printhead modules 3 and channels 19 are flushed when a color for the printhead module 3 is changed. This may prevent that fluid of a previous color or colorant concentration, used for the same printhead module 3, is mixed with the new color. In an example, a predetermined flush fluid is used for flushing.

Figure 4:
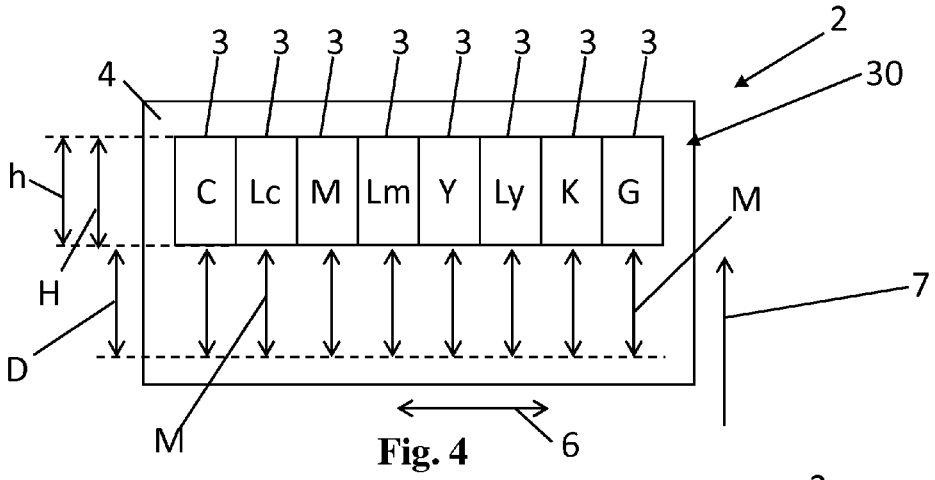
FIG. 4 shows a diagram of an example of a printhead assembly in top view.

FIG. 4 shows an example of a diagram of a printhead assembly 2. An example advance direction 7 of the media 8 with respect to the printhead assembly 2 is indicated. The shown printhead modules 3 are arranged to print C, Lc, M, Lm, Y, Ly, K and Grey (G). In the shown example diagram, the printhead modules 3 each print different colors. In the shown example, the printhead assembly 2 is arranged in a printhead arrangement 30, wherein the printhead modules 3 are arranged in line, for example in one row. The shown example of the printhead arrangement 30 may be configured to print in the first mode.

The printhead modules 3 of the printhead assembly 2 are arranged to move with respect to each other. For example, in a scanning printhead assembly 2, the printhead modules 3 may move parallel to the media advance direction 8, in a shown direction M. For example, the chassis 4 may include guides, slides and/or actuators for moving the printhead modules 3 with respect to each other in the shown direction M.

For example, the printhead modules 3 are arranged to move over at least one predetermined distance D with respect to each other. The predetermined distance D may be set according to a desired print mode. For example, the print mode may have a predetermined media advance speed and/or print resolution. In an example of a scanning printhead assembly 2, the printhead modules 3 are arranged to shift one swath height h with respect to their original position within the printhead assembly 2. In this example, the swath height is equal to the height of the printhead module 3. The respective printhead module shifts may change a total swath height H, H2 of the printhead assembly 2 and may provide a predetermined output resolution of the printhead assembly 2. In an example, the printhead modules 3 may move slightly more or less than a concrete swath height h, for example when a certain nozzle redundancy is present in the printhead assembly 2, or for other reasons.

Figure 5:
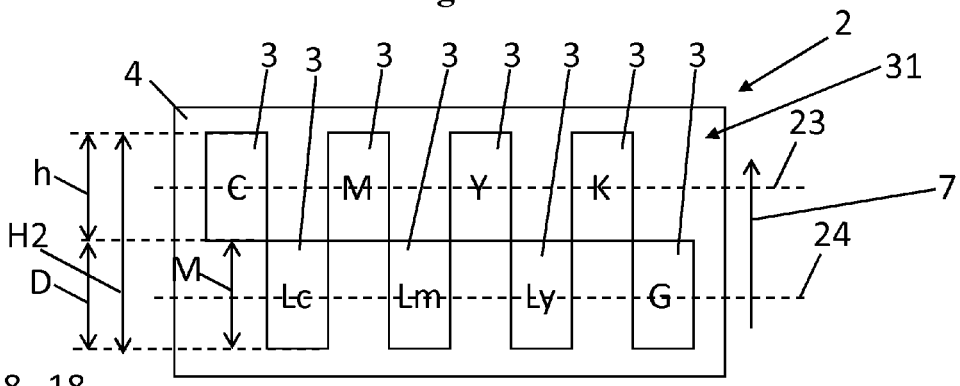
FIG. 5 shows a diagram of the example of FIG. 4 in top view, in a different arrangement.

FIG. 5 shows an example of the printhead assembly 2 of FIG. 4 in another arrangement 31, wherein the printhead modules 3 have been moved with respect to each other over the predetermined distance D. The shown example of the printhead arrangement 31 may be configured to print in the second mode. In the example of FIG. 5, the printhead modules 3 are in a staggered arrangement 31 with respect to each other, wherein a first array of printhead modules 3 is arranged along a first line 23 and a second array is arranged along a second virtual line 24 that is parallel to the first line 23.

The output resolution of the printhead assembly 2 in the arrangement 31 shown in FIG. 5 may be different than the output resolution of the printhead assembly 2 in the arrangement 30 shown in FIG. 4. For example, with the arrangement 30 of FIG. 4 more dots are printed on a horizontal line. Since the total swath height H of the printhead assembly 2 of FIG. 4 is lower, more scanning strokes may be needed for filling the printed image. For example, the printhead arrangement 31 of FIG. 5 may be suitable to output a lower resolution than the arrangement 30 of FIG. 4 because it has a larger swath height H2. The skilled person understands that the output resolution also depends on the chosen scanning algorithm and/or media advance speed.

In the example of FIG. 5 the printhead modules 3 have been moved over a distance D approximately equal to one printhead swath height h. The total swath height H2 of the printhead assembly 2 of FIG. 5 may be twice the printhead assembly swath height H of FIG. 4. The larger total swath height H2 may allow for a higher media advance speed. For example, a smaller printhead assembly swath height H (FIG. 4) may be used for relatively high quality or high resolution printing, such as printouts that are meant to be viewed from relatively nearby such as point of purchase (POP) printouts. In another example, a larger printhead assembly swath height H2 (FIG. 5) may be used when a higher speed is desired, and/or a relatively low resolution would be sufficient, for example for larger printouts that are meant for viewing at a distance such as billboard printouts. The movement distance D of respective individual printhead modules 3 or groups or arrays of printhead modules 3 in the printhead assembly 2 may be determined according to a desired resolution and/or print speed.

Figure 6:
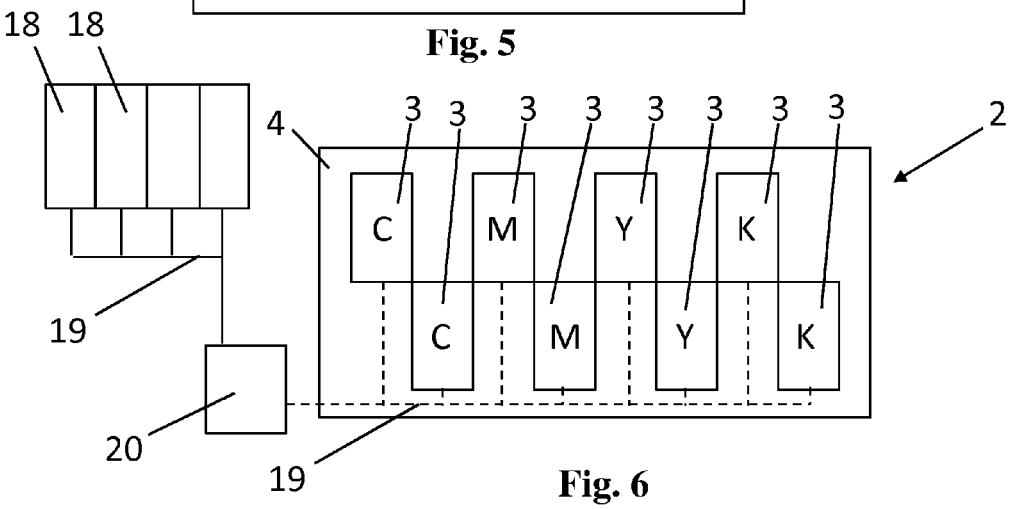
FIG. 6 shows a diagram of the example of FIG. 4 in top view, in again a different arrangement.

In FIG. 6, an example of the printhead assembly 2 of FIGS. 4 and 5 is shown, in again another arrangement. Also diagrammatic examples of the fluid flushing system 20, fluid reservoirs 18 and fluid channels 19 connected to the printhead modules 3 are shown. In FIG. 6, colors of the printhead modules 3 of the printhead assembly 2 were replaced with respect to the arrangements of FIG. 4 or 5. For example, the original colors Lc, Lm, Ly, G have been replaced by C, M, Y, K. For example, in FIG. 6 C, M, Y, K fluid reservoirs 18 have been connected to the printhead modules 3 that in FIG. 4 or 5 where connected to Lc, Lm, Ly, G fluid reservoirs 18, respectively. For example, the respective printhead modules 3 have been flushed before connection to the other colored fluids. In the shown example, the printhead assembly 2 has two rows of printhead modules 3, each row having the same color array.

For example, the fluid reservoirs 18 connected to the printhead modules 3 of the example of FIG. 6 contain fluid with a relatively high concentration of colorant, for example fluid having at least approximately 4% of colorant in weight. In a further example, the shaping fluid dispenser 15 is arranged to flatten the printed dots of highly concentrated fluid. By flattening the dots and using a higher concentration of colorant, less fluid may be consumed during printing, while printing may be performed at relatively high speed. The example of FIG. 6 may be suitable for billboard printing.

Figure 7:
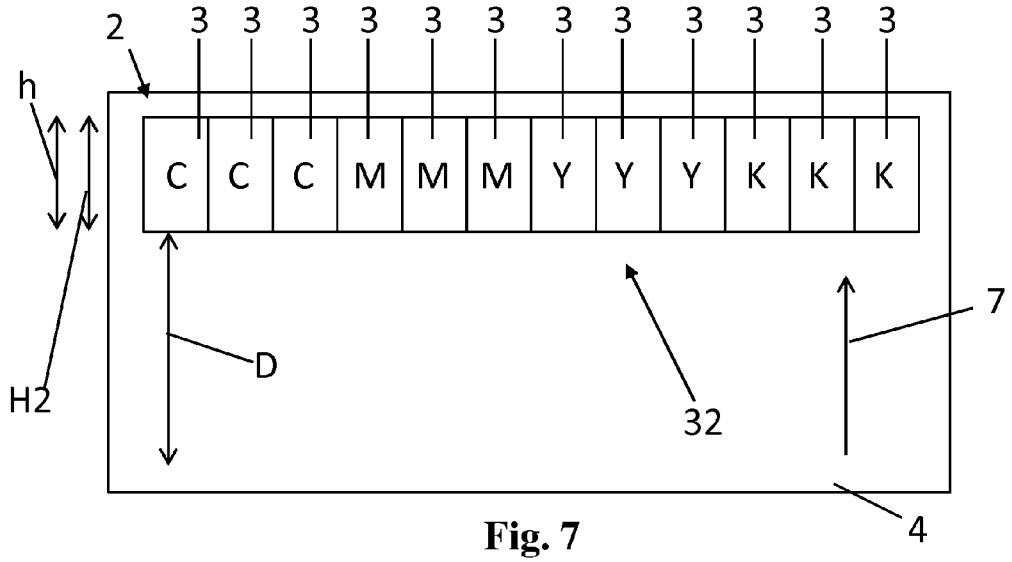
FIG. 7 shows a diagram of another example of a printhead assembly in top view.
Figure 8:
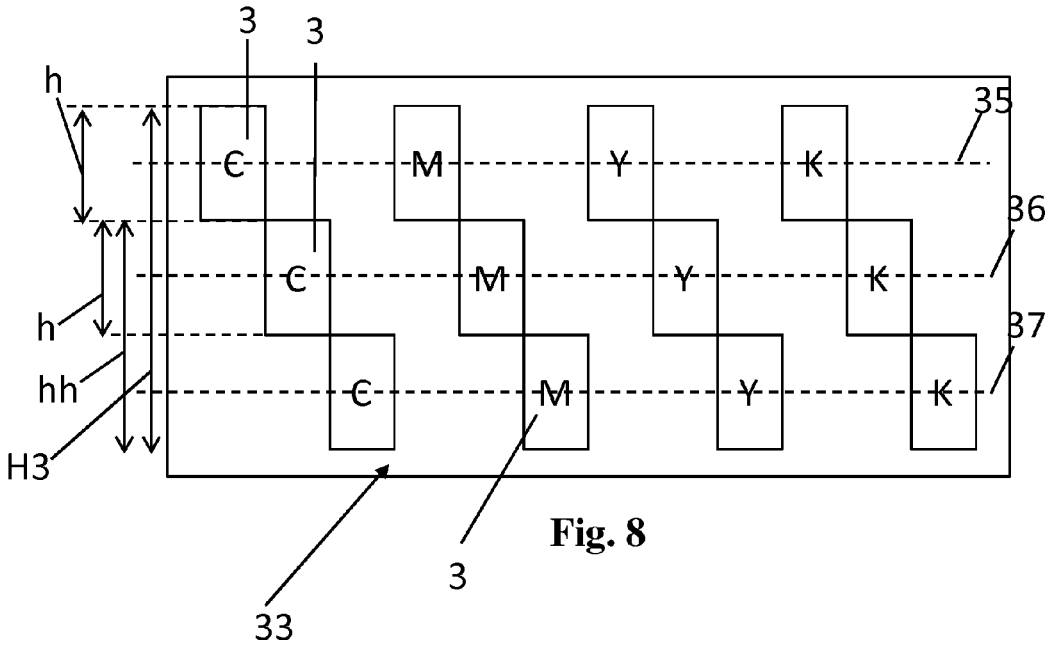
FIG. 8 shows a diagram of the example of FIG. 7 in top view, in a different arrangement.

FIGS. 7 and 8 show diagrams of another example of a printhead assembly 2 in a first and second mode, respectively. FIGS. 7 and 8 show different printhead arrangements 32, 33 of the same assembly 2. In the shown examples multiple printhead modules 3 may eject the same color of fluid. For example, in FIG. 7 the printhead assembly 2 may include at least four different colors, wherein each color corresponds to at least three printhead modules 3.

The chassis 4 may be arranged to allow movement of the printhead modules 3 with respect to each other, parallel to the media advance direction 7. The chassis 4 may be arranged to allow movement of the printhead modules 3 over a distance D that is more than a swath width h, for example approximately two swath widths h. As a result, the total swath width H3 that may be covered by the printhead assembly 2 of FIG. 7-9 may be at least approximately three swath widths h.

FIG. 8 shows an example, wherein for each color the printhead modules 3 are moved over one swath height h with respect to each other. For example, for each color a second printhead module 3 is moved over one swath height h with respect to a first printhead module 3, and a third printhead module 3 is moved over one swath height h with respect to the second printhead module 3 and two swath heights hh with respect to the first printhead module 3. As shown, the printhead modules 3 are in a staggered arrangement 33, each step covering one swath height h, so that three printhead module arrays are arranged along three respective virtual straight lines 35, 36, 37.

Figure 9:
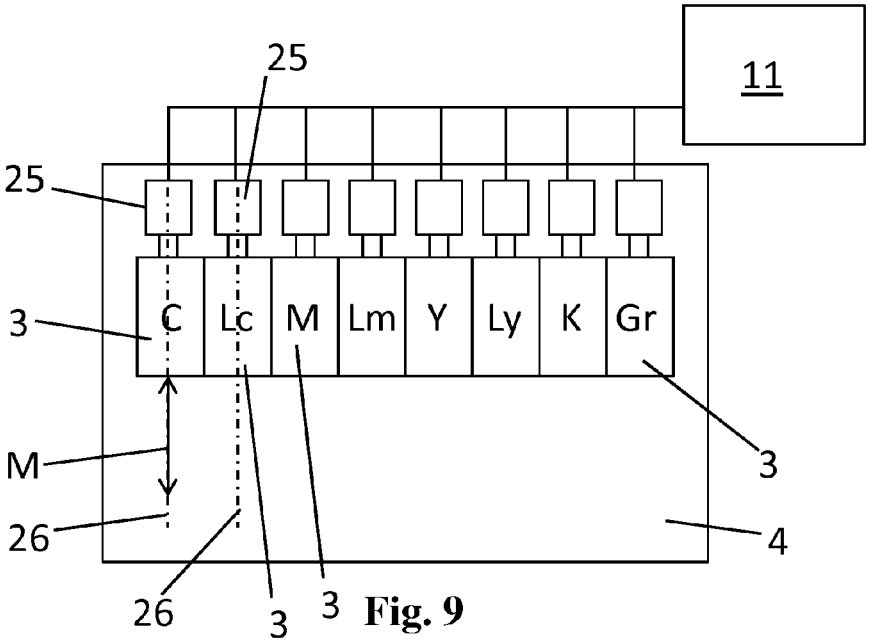
FIG. 9 shows a diagram of again another example of a printhead assembly in top view.

FIG. 9 shows an example of a printhead assembly 2. The printhead assembly 2 includes a chassis 4. The example printhead assembly 2 includes printhead module movement actuators 25. The movement actuators 25 are mounted on the chassis 4 and are arranged to move the printhead modules 3 along a straight axis 26, in the movement direction M. The movement actuators 25 may be triggered through an electrical signal, for example from the control circuit 11. The actuators 25 may include pneumatic or hydraulic actuators, electromotors, slides, etc. For example, the straight axis 26 may be determined by a guide, slide, and/or the actuator 25 itself. For example, the printhead assembly 2 includes at least one actuator 25. For example, each actuator 25 may be arranged to move one or more printhead modules 3, or one or more printhead module arrays. In another example, the printhead modules 3 may be moved manually, for example over a guide or the like.

Figure 10:
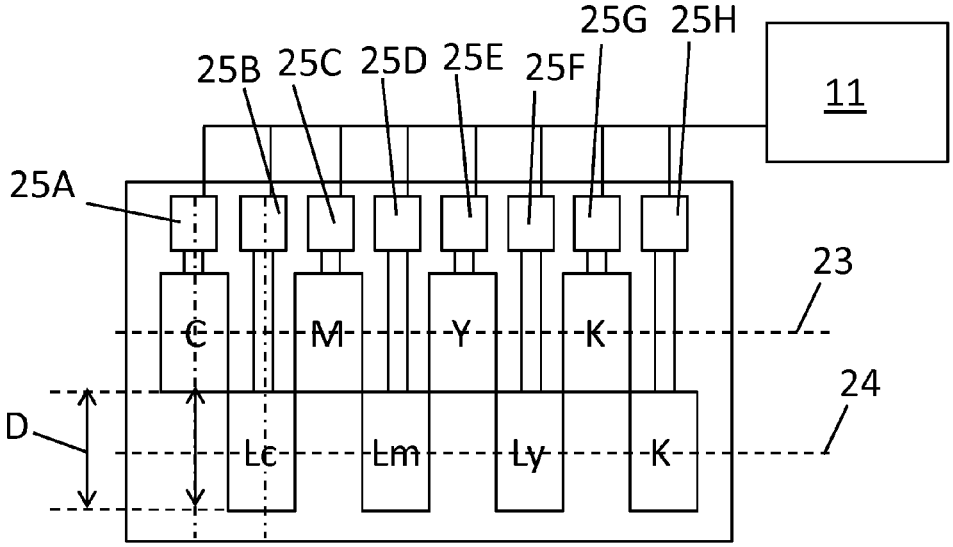
FIG. 10 shows a diagram of the example of the printhead assembly of FIG. 9 in top view, in a different arrangement.

In FIG. 10, the printhead modules 3 are arranged in a two-stepped staggered arrangement, over the two parallel virtual lines 23, 24. The printhead module array in the second virtual line 24 has been moved by the actuators 25B, 25D, 25E, 25G corresponding to each of the printhead modules 3. In the shown example, the moved actuators 25B, 25D, 25F, 25H are in an extended position. In another example, one actuator 25 could be used to move the entire printhead module array one step down to the second virtual line 24. Certain other example printhead assemblies 2 could have more printhead modules 3, wherein the printhead modules 3 could be arranged in more than two lines, for example in three or four lines (i.e. three or four-stepped).

In the examples of FIGS. 9 and 10, the control circuit 11 is configured to receive instructions associated with a particular print mode, for example a print mode corresponding to a lower resolution. The control circuit 11 is configured to, upon receiving these instructions, instruct the printhead module movement actuators 25, 25A-H to move the predetermined printhead modules 3 over the predetermined distance D. The predetermined distance D may be the distance D that corresponds to the chosen print mode, for example as shown in FIG. 11.

Figure 11:
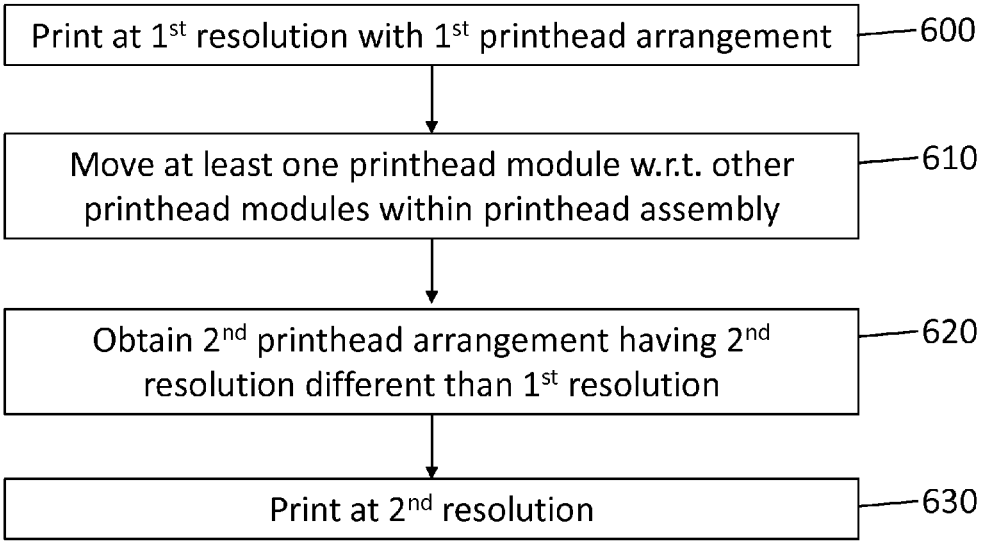
FIG. 11 shows a flow chart of an example of a method of printing.

FIG. 11 shows a flow chart of an example of a method of printing. In an example, the method includes printing a fluid onto media at a first resolution using a first arrangement 30, 32 of the printhead modules 3 (block 600). In an example, the method includes moving at least one printhead module 3 with respect to the other printhead modules 3 in the printhead assembly 2 (block 610). In an example, the method includes obtaining, by said printhead module movement of block 610, a second printhead arrangement 31, 33, 34 that corresponds to a second resolution different than the first resolution (block 620). In an example, the method includes printing at said second resolution (block 630).

Figure 12:
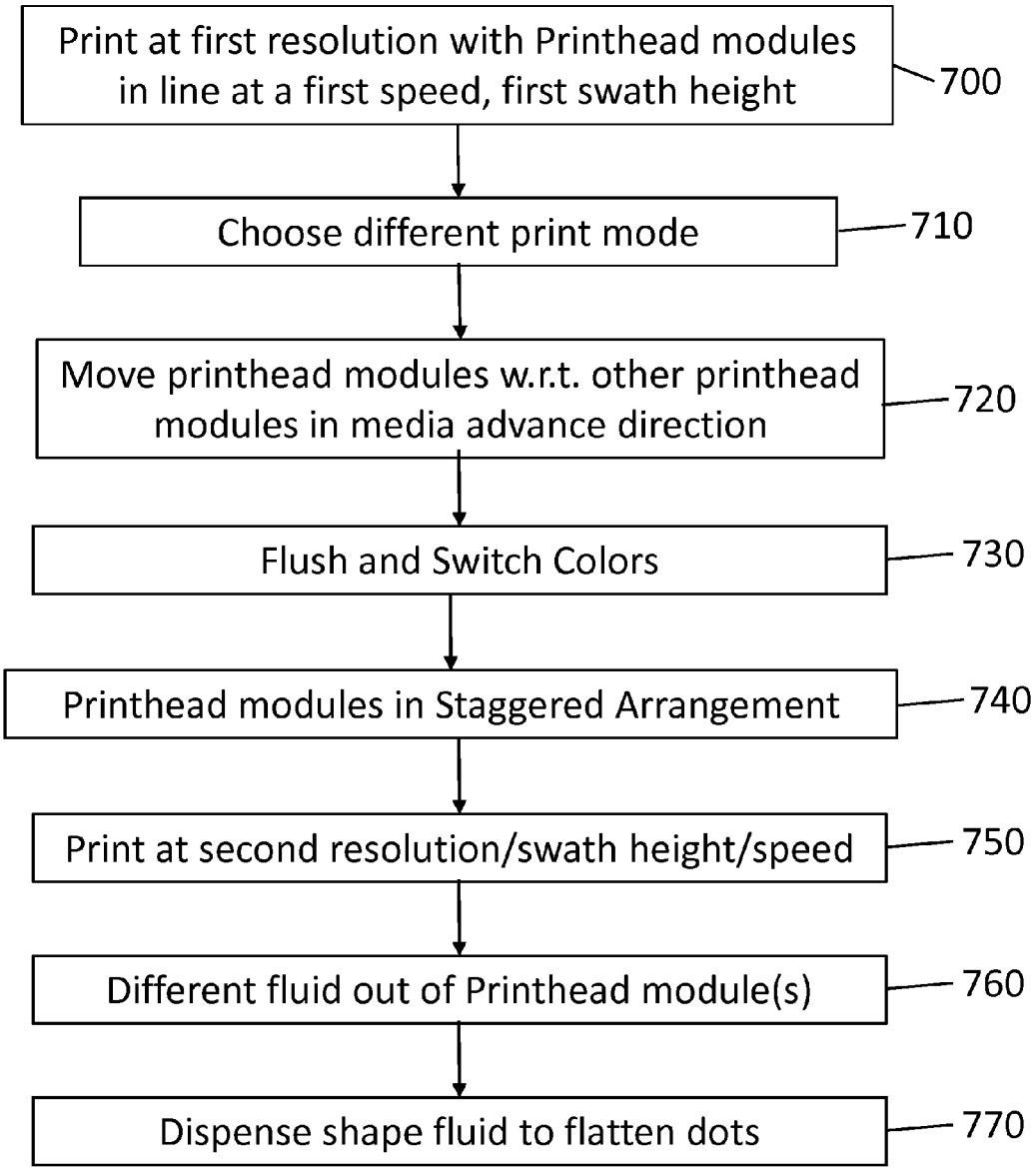
FIG. 12 shows a flow chart of another example of a method of printing.

FIG. 12 shows a flow chart of another example of a method printing. In an example, the method includes printing a first image at a first resolution wherein the printhead modules 3 are in line, at a first speed (block 700). For example, the image is printed by scanning the printhead module 3 over the media 8, wherein the printhead assembly 2 has a first swath height H. In an example, the method includes subsequently choosing a print mode different than the previous print mode (block 710). For example, a print mode corresponding to a different resolution and/or different media advance speed than the first image may be selected through an operator panel 14. In an example, the method includes moving at least one printhead module 3 in a direction that is parallel to a media advance direction 7 (block 720).

In an example, at least one printhead module 3 is flushed and a fluid connected to the printhead module 3 is changed (block 730). For example, the different fluid may be of a different color or may have a different colorant concentration. For example the fluid connected to one or more printhead modules 3 may be changed. For example, light colors such as Lc, Lm and Ly may be exchanged for full colors such as C, M, Y or vice versa. For example, the fluid used for the first image may have a colorant weight concentration of less than 4% while the fluid for the second image has a colorant weight concentration of approximately 4% or higher, or vice versa. The flushing and fluid changing may take place before or after moving the printhead modules 3 in the printhead assembly 2.

For example, moving some of the printhead modules 3 increases a printhead assembly swath height H, H2, H3. The printhead modules 3 may move from a first arrangement 30, 32, wherein the printhead modules 3 are in line, to a second arrangement 31, 33, 34, wherein the printhead modules 3 are in a staggered arrangement 31, 33, 34 (block 740). Then, a second image may be printed, for example at a second resolution, second media advance speed and/or second swath height H2, H3 with respect to the first image (block 750). For example, in the second arrangement 31, 33, 34, the resolution may be lower, the media advance speed may be higher, and/or the swath height H2, H3 may be larger than in the first arrangement 30, 32. In an example, the method includes that for the second image at least one printhead modules 3 ejects a different fluid onto the media 8 than for the first image (block 760). For example, the different fluid may have a different color or a different colorant concentration. In an example, the fluid that is ejected for the second image has a higher colorant concentration than for the first image, for example approximately 4% or more. In an example, the method includes dispensing a shaping fluid onto the printed fluid dots on the media 8 to flatten the printed dots (block 770).

In one aspect, this disclosure includes a print system 1, including a first and second printhead module 3, a printhead module actuator 25 for moving the first printhead module 3, and a control circuit 11 configured to receive instructions associated with a print mode, and upon receiving said instructions instruct the respective printhead module actuator 25 to move the first printhead module 3 with respect to the second printhead module 3, over a predetermined distance D, to alter a print resolution.

The above description is not intended to be exhaustive or to limit this disclosure to the examples disclosed. Other variations to the disclosed examples can be understood and effected by those skilled in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

The invention claimed is:

1. A printhead assembly comprising:

printhead modules for printing colored fluids onto media, arranged to move with respect to each other over at least one predetermined distance as corresponding to a desired print mode;

wherein the printhead modules are arranged to switch between an arrangement wherein the printhead modules are in line and a staggered arrangement, and in the staggered arrangement a first printhead module array is arranged along a first line, and a second printhead module array is arranged along a second line distanced from and parallel to the first line.

2. The printhead assembly according to claim 1, arranged to move with respect to each other parallel to a media advance direction.

3. The printhead assembly according to claim 1, comprising a scanning printhead assembly, wherein the at least one predetermined distance is approximately one swath height.

4. The printhead assembly according to claim 1, comprising:

a chassis, and printhead module movement actuators, mounted on the chassis, for moving the printhead modules along a straight axis.

5. A print system comprising:

a printhead assembly comprising printhead modules for printing colored fluids onto media, arranged to move with respect to each other over at least one predetermined distance as corresponding to a desired print mode;

an operator panel configured to receive instructions associated with a print mode, and a control circuit configured to, upon receiving the instructions associated with the print mode, instruct the printhead module movement actuators to move predetermined printhead modules over a predetermined distance corresponding to the print mode.

6. A print system, comprising:

a printhead assembly comprising printhead modules for printing colored fluids onto media, arranged to move with respect to each other over at least one predetermined distance as corresponding to a desired print mode; and a flush system for flushing the printhead modules with a flushing fluid.

7. A print system, comprising:

a printhead assembly comprising printhead modules for printing colored fluids onto media, arranged to move with respect to each other over at least one predetermined distance as corresponding to a desired print mode;

fluid reservoirs, containing concentrated fluid having more than 4% colorant concentration in weight, and a shaping fluid outlet arranged to dispense shaping fluid onto printed concentrated fluid for flattening the dots.

8. A method of printing, comprising:

printing at a first resolution using a first printhead arrangement of a printhead assembly, moving at least one printhead module with respect to other printhead modules in the printhead assembly, so that a second printhead arrangement of the printhead assembly is obtained that corresponds to a second resolution different than the first resolution, printing at the second resolution, printing a first image wherein the printhead modules are in line, and printing a second image wherein the printhead modules are in a staggered arrangement, at a lower resolution and a higher media advance speed than the first image.

9. The method according to claim 8, comprising moving the at least one printhead module parallel to the media advance direction.

10. A method of printing, comprising:

printing at a first resolution using a first printhead arrangement of a printhead assembly, moving at least one printhead module with respect to other printhead modules in the printhead assembly, such that a second printhead arrangement of the printhead assembly is obtained that corresponds to a second resolution different than the first resolution, printing at the second resolution, ejecting a first fluid out of a first printhead module, flushing the first printhead module before or after moving it, and after moving, ejecting a second fluid having a different color than the first fluid out of the first printhead module.

11. A method of printing, comprising:

printing at a first resolution using a first printhead arrangement of a printhead assembly, moving at least one printhead module with respect to other printhead modules in the printhead assembly, such that a second printhead arrangement of the printhead assembly is obtained that corresponds to a second resolution different than the first resolution, printing at the second resolution, printing dots of fluid containing at least 4% of colorant in weight, and flattening the dots by dispensing shaping fluid onto the dots.

12. A method of printing, comprising:

printing at a first resolution using a first printhead arrangement of a printhead assembly, moving at least one printhead module with respect to other printhead modules in the printhead assembly, such that a second printhead arrangement of the printhead assembly is obtained that corresponds to a second resolution different than the first resolution, printing at the second resolution, printing by scanning the printhead assembly over a substrate, printing with a first swath height, moving the at least one printhead module with respect to the other printhead modules, and printing with a second swath height different than the first swath height.

13. Print system, comprising:

a first and second printhead module, a printhead module actuator for moving the first printhead module, and a control circuit configured to receive instructions associated with a print mode, and upon receiving said instructions, instruct the printhead module actuator to move the first printhead module with respect to the second printhead module, over a predetermined distance, to alter a print resolution.

* * * * *